United States Patent [19]

Jacobszoon

[11] 3,989,205

[45] Nov. 2, 1976

[54] MANDREL FOR COLLECTING WIRE COILS

[75] Inventor: Hans Wilhelm Jacobszoon, Saarbrucken-Fechingen, Germany

[73] Assignee: Schloemann-Siemag Aktiengesellschaft, Dusseldorf, Germany

[22] Filed: May 7, 1975

[21] Appl. No.: 575,175

[30] Foreign Application Priority Data

May 13, 1974 Germany ..... 2423009

[52] U.S. Cl. ..... 242/129; 242/110

[51] Int. Cl.[2] ..... B65H 49/00

[58] Field of Search ..... 242/129, 110–110.2, 242/72

[56] References Cited

UNITED STATES PATENTS

| | | | |
|---|---|---|---|
| 2,285,826 | 6/1942 | Naumann | 242/129 |
| 3,326,495 | 6/1967 | DeBruyn | 242/129 |
| 3,820,736 | 6/1974 | Moor | 242/110.2 |

*Primary Examiner*—Leonard D. Christian

*Attorney, Agent, or Firm*—Toren, McGeady and Stanger

[57] ABSTRACT

A device for collecting wire coils passing in a fan-like arrangement from a rolling train and forming the coils into a bundle or ring consists of an axially extending mandrel and a plurality of stringers located radially outwardly from the mandrel and extending generally parallel relative to its axis. The stringers are supported for movement in the radial direction toward and away from the mandrel.

4 Claims, 1 Drawing Figure

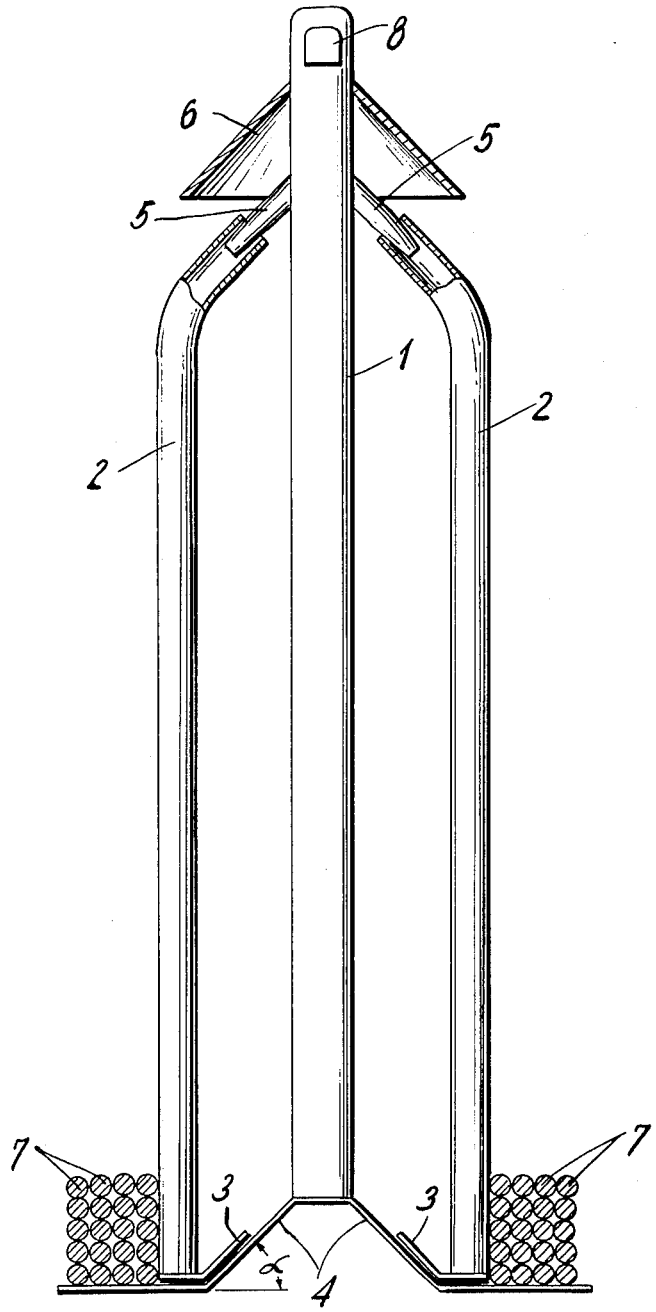
8
6
5
5
1
2
2
7
7
3
3
α
4

MANDREL FOR COLLECTING WIRE COILS

SUMMARY OF THE INVENTION

The present invention is directed to a mandrel for collecting wire coils passing in a fan-like arrangement from a rolling train and forming the coils into a bundle or ring and, more particularly, it concerns the arrangement of stringers positioned radially outwardly from and movable in the radial direction relative to the mandrel.

Rolling trains are known with which apparatus is associated for providing the controlled cooling of rolled wire. In such apparatus as the wire, in the form of coils or turns, passes from the rolling train, it is cooled and then collected into a bundle or ring of the coils. Such an apparatus is shown in U.S. Pat. No. 3,231,432, 3,320,101 and 3,390,871. The collection of the individual coils is accomplished on a coiling means or mandrel which has several stationary stringers or spars. The mandrel also serves as a transporting means for the bundle or ring of the wire coils. The mandrel and the bundle supported on the mandrel are then supplied to a press, the bundle is compacted, and the mandrel is withdrawn from the bundle so that the bundle is then ready for shipment.

This equipment used in the prior art has the disadvantage that the finished ring or bundle of wire coils is noticeably damaged at its inner sides. During the compacting operation, the individual coils of the bundle are pressed to such an extent against the stationary or rigid stringers or spars on the mandrel that, due to the friction developed between the coils and the stringers during the compacting step, the coils are damaged. Further, the removal of the mandrel from the compacted bundle also has a damaging effect as the mandrel with its stationary spars is withdrawn from the coils which bear tightly against the spars. As a result, the bundle of wire coils may be rendered unusable. Moreover, the mandrels are also subject to considerable wear and tear.

The purpose of the present invention is to provide a mandrel for collecting and forming the wire coils into a bundle without experiencing the disadvantages mentioned above.

In accordance with the present invention, the problems previously experienced are overcome by supporting the stringers or spars on the mandrel in a movable manner.

In accordance with one embodiment of the invention, the stringers or spars are supported for movement in the direction extending radially of the axis of the mandrel. In such a mandrel, a support member is provided at one end of the mandrel with a support surface thereon extending obliquely of the axis of the mandrel and at the other end guide elements are provided extending outwardly from the mandrel. At one end the stringers each have a guide rail bearing on the support surface of the support member while at the other end the stringers are guided by the guide elements with the orientation of the support surface and the guide elements being such that the stringers can move radially inwardly and outwardly.

By virtue of the arrangement afforded by the present invention it is possible for the stringers on the mandrel to adapt themselves to the shape of the individual wire coils, that is, the stringers can move to accommodate any differences between the individual coils. In this manner, it is possible to form the wire coils into bundles without causing any damage to the wire coils, and wear and tear on the mandrel is practically eliminated.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWING

The drawing is a somewhat schematic showing partially in section of a mandrel embodying the present invention.

DETAILED DESCRIPTION OF THE INVENTION

In the drawing an axially extending mandrel 1 is shown with a plurality of stringers or spars 2 arranged around the mandrel 1. As viewed in the drawing, the lower end of each stringer 2 has a glide rail 3 extending inwardly toward the mandrel and disposed at an oblique angle to the mandrel axis. A support member 4 is provided at the corresponding lower end of the mandrel and provides a support surface on which the glide rail 3 bears. The support surface of the support member 4 is disposed at the same oblique angle to the mandrel axis as the glide rail, note the angle $\alpha$. At the upper end of the mandrel 1, as shown in the drawing, guide elements 5 project outwardly at an oblique angle to the axis of the mandrel and project into the upper ends of the arms 2. The angle of the guide elements relative to the mandrel axis corresponds generally to the angle of the support surface of the support member 4. Above the guide element 5, a cover 6 is provided so that individual coils 7 can pass downwardly onto the mandrel 1 without any interference provided by the upper ends of the stringers 2 or the guide elements 5. At the upper end of the mandrel 1, above the cover 6, an ear 8 is provided for effecting the transportation of the mandrel 1.

If the individual coils 7 passing from the rolling train in a fan-like manner, are gathered or collected after passing through a cooling station, the collection of the coils is effected by the mandrel 1. During this collection operation, as the coils are gathered into a bundle or ring, the stringers 2 are movable to accommodate the size of the individual coil passing downwardly over the mandrel. If an individual coil is smaller than the others, the stringers slide on the support surface of the support member inwardly and are guided in the same direction at the opposite ends of the stringers by the guiding elements 5 and by the glide rails 3 bearing on the support; surface of the support member 4. As a result, the wire coils which are still warm remain undamaged. If, during the collection operation as additional coils 7 pass over the mandrel, the previously mentioned narrower coil assumes a different position, then the stringers will move radially relative to the axis of the mandrel, on the obliquely oriented support surface of the support member 4 and guided by the guiding elements 5 to provide the requisite contact or support for the multiple coils 7. Accordingly, as the collecting operation continues though the individual coils are still warm and possible susceptible to damage, any excessive friction between the coils and the stringers 2 is avoided.

The movability of the stringers 2 relative to the mandrel is of even greater importance during the subsequent operation when the individual coils are compacted together into a bundle and the mandrel device is removed from the bundle. From a practical viewpoint, when the compacting action takes place the coils 7 are strongly compressed to provide a smaller bundle as concerns its width. Further, when this compacting action takes place, the stringers or spars 2 adapt themselves to the inner surface of the bundle so that the compaction of the individual coils and the removal of the mandrel device is possible without any complications. Furthermore, as the mandrel device is removed the bundle of coils remains undamaged.

The embodiment illustrated and described is merely exemplary of the invention and is not intended to limit its scope. Other means for providing the movement of the spars can be utilized. Accordingly, instead of the obliquely arranged support surface and guide elements, it would be possible to have the stringers move against spring means so that they are not displaced obliquely of the mandrel axis but rather move in a normal direction.

While a specific embodiment of the invention has been shown and described in detail to illustrate the application of the inventive principles, it will be understood that the invention may be embodied otherwise without departing from such principles.

What is claimed is:

1. A device for collecting the fan-like wire coils from a rolling train and forming the coils into a bundle or ring, said device comprising an axially extending mandrel having a first end and a second end with the second end located downstream from the first end relative to the direction in which the coils move over said mandrel, wherein the improvement comprises a plurality of stringers spaced radially outwardly from and extending in the same general direction as the axial direction of said mandrel, and means for supporting said stringers for movement in the radial direction relative to the axis of said mandrel, said means comprising a support member located at the second end of said mandrel with said support member having a support surface disposed at an oblique angle to the axis of said mandrel, each said stringer having a guide rail at one end extending in generally parallel relation with the support surface of said support member and in contact with the support surface, a guide device secured to said mandrel adjacent the first end thereof, each of said stringers at the opposite end from said guide rail being movably supported on said guide device so that each said stringer can move radially inwardly and outwardly relative to the axis of said mandrel supported by said support member and guide device, said guide device comprising a guide element for each said stringer, each said guide element arranged to interengage with the end of said stringer with which it is associated so that said stringer can be moved relative to said guide element along a line generally parallel to the direction of said guide rail on said support surface.

2. A device for collecting the fan-like wire coils from a rolling train and forming the coils into a bundle or ring, said device comprising an axially extending mandrel having a first end and a second end with the second end located downstream from the first end relative to the direction in which the coils move over said mandrel, wherein the improvement comprises a plurality of stringers spaced radially outwardly from and extending in the same general direction as the axial direction of said mandrel, means for supporting said stringers for movement in the radial direction relative to the axis of said mandrel, said means comprising a support member located at the second end of said mandrel with said support member having a support surface disposed at an oblique angle to the axis of said mandrel, each said stringer having a guide rail at one end extending in generally parallel relation with the support surface of said support member and in contact with the support surface, a guide device secured to said mandrel adjacent the first end thereof, each of said stringers at the opposite end from said guide rail being movably supported on said guide device so that each said stringer can move radially inwardly and outwardly relative to the axis of said mandrel supported by said support member and guide device, said guide device comprises a guide element for each said stringer, each said guide element arranged to fit into the end of said stringer with which it is associated with said guide element extending in generally parallel relation to said support surface on which said guide rail on the opposite end of each said stringer is supported so that said stringer can be moved relative to said guide element along a line generally parallel to the direction of said guiderail passing over said support surface.

3. A device for collecting the fan-like wire coils from a rolling train and forming the coils into a bundle or ring, said device comprising an axially extending mandrel having a first end and a second end with the second end located downstream from the first end relative to the direction in which the coils move over said mandrel, wherein the improvement comprises a plurality of stringers spaced radially outwardly from and extending in the same general direction as the axial direction of said mandrel, means for supporting said stringers for movement in the radial direction relative to the axis of said mandrel, said means comprising a support member located at the second end of said mandrel with said support member having a support surface disposed at an oblique angle to the axis of said mandrel, each said stringer having a guide rail at one end extending in generally parallel relation with the support surface of said support member and in contact with the support surface, a guide device secured to said mandrel adjacent the first end thereof, each of said stringers at the opposite end from said guide rail being movably supported on said guide device so that each said stringer can move radially inwardly and outwardly relative to the axis of said mandrel supported by said support member and guide device, and a cover extending radially outwardly from said mandrel between the first end thereof and said guide device for directing wire coils onto said mandrel for passage around said stringers.

4. A device, as set forth in claim 3, wherein an ear is located on said mandrel between the first end thereof and said cover for use in transporting said mandrel.

* * * * *